US006016952A

United States Patent [19]

Smith et al.

[11] Patent Number: 6,016,952

[45] Date of Patent: Jan. 25, 2000

[54] NESTED BOX WITH INTEGRATED LID AND REINFORCED SEAM

[75] Inventors: Jeffrey A. Smith, Clark; Richard N. Beneroff, Chatham; Eric Kim, Secaucus, all of N.J.

[73] Assignee: Motion Design, Inc., Linden, N.J.

[21] Appl. No.: 09/072,975

[22] Filed: May 5, 1998

[51] Int. Cl.[7] ..... B65D 5/36

[52] U.S. Cl. ..... 229/117; 229/142; 229/145; 229/155; 229/185.1; 229/192

[58] Field of Search ..... 229/117, 127, 229/138, 139, 142, 145, 151, 155, 158, 185.1, 192

[56] References Cited

U.S. PATENT DOCUMENTS

| | | | |
|---|---|---|---|
| 460,817 | 10/1891 | Clark | 229/139 |
| 1,928,660 | 10/1933 | Boeye | 229/127 |
| 2,284,815 | 6/1942 | Grimm | 229/120.08 |
| 2,307,913 | 1/1943 | Bergstein | 229/139 |
| 2,327,709 | 8/1943 | Himes . | |
| 2,577,588 | 12/1951 | Paige . | |
| 2,843,308 | 7/1958 | Paige . | |
| 3,278,108 | 10/1966 | Paige . | |
| 3,361,326 | 1/1968 | Croley et al. | 229/192 |
| 3,430,840 | 3/1969 | Paige . | |
| 3,780,932 | 12/1973 | McLaren et al. . | |
| 3,801,001 | 4/1974 | Taylor | 229/139 |
| 3,913,824 | 10/1975 | Paige . | |
| 3,960,312 | 6/1976 | Gorham . | |
| 4,182,477 | 1/1980 | Paige . | |
| 4,272,009 | 6/1981 | Bamburg et al. | 229/139 |
| 4,325,493 | 4/1982 | Paige . | |
| 4,373,660 | 2/1983 | Wytko . | |
| 4,403,729 | 9/1983 | Wytko | 229/151 |
| 4,406,380 | 9/1983 | Paige . | |
| 4,795,081 | 1/1989 | Miller . | |
| 4,899,929 | 2/1990 | Grollman | 229/122.1 |
| 5,011,071 | 4/1991 | Lopez | 229/117 |
| 5,275,331 | 1/1994 | Chung-Piao | 229/117.15 |
| 5,579,989 | 12/1996 | Roy et al. | 229/110 |

FOREIGN PATENT DOCUMENTS

| | | | |
|---|---|---|---|
| 73698 | 9/1944 | Czechoslovakia | 229/155 |

*Primary Examiner*—Gary E. Elkins
*Attorney, Agent, or Firm*—Kenyon & Kenyon

[57] ABSTRACT

The present invention provides for an improved telescoping container, which is set up and collapsed flat quickly and easily, and is provided to the user in one integral piece, eliminating the necessity of a lid being assembled or maintained separately. An integral lid provides an improved amount of cushioning and strength, and does not enter the cubic volume of the container and thus reduce available storage space. In one embodiment of the invention the container gains strength from a double glued seam, having opposing edges sealed to one another with two tabs; alternatively one of the two tabs is sealed. The container sets up by having an inner portion telescope into an outer portion, and may be collapsed flat by pulling the inner portion back out of the outer portion. In one embodiment the ease of set up is further improved by forming the lid from a continuous sheet of material, so that the lid may be closed in one motion, rather than the sequence of steps required with other lids. The lid of this embodiment is composed of multiple layers connected by folds which act as springs, and thus provides a springed, cushioned barrier to protect the contents of the container. When closed, the lid keeps the inner portion in place and thus adds to the strength of the container. In another embodiment the lid may be constructed of multiple panels, extending from both the inner and outer portions. The container is intended to be cut and glued at a manufacturer's facility and shipped flat to the user, who erects the container.

24 Claims, 14 Drawing Sheets

NESTED BOX WITH INTEGRATED LID AND REINFORCED SEAM

BACKGROUND OF THE INVENTION

The present invention relates to a nested container which is set up from and returns to a flat condition quickly and easily.

Nested containers which are set up from and returned to a flat condition quickly and easily, for example by telescoping an inner portion into an outer portion, are known. An example of such a container is shown in U.S. Pat. No. 2,577,588, which is expressly incorporated by reference herein. During set up, panels which connect the inner and outer portions collapse and fold to form the bottom of the container.

While such prior art containers are convenient, a separate lid must be stored and assembled to complete the container. Furthermore, existing lids often do not provide enough cushioning or strength, and may enter the cubic volume of the container and thus reduce available storage space. In addition, while such containers gain strength from having a double walled construction, improvements to their strength can be made.

SUMMARY OF THE INVENTION

It is therefore desirable to have an easily set up and collapsible container which has a lid which is integral to the container so that users do not have to maintain a separate stock of lids or assemble a separate piece to complete the container. It is desirable to provide such a container with an easily closed lid which provides an improved amount of cushioning and strength, and which will not enter the cubic volume of the container and thus reduce available storage space. It is further desirable to have a container with more strength than existing telescoping double walled containers.

The present invention provides for an improved telescoping container, which sets up and collapses quickly and easily, and is provided to the user in one integral piece, eliminating the necessity of a lid being assembled or maintained separately. The container is set up by having an inner portion telescope into an outer portion, and may be collapsed by pulling the inner portion back out of the outer portion. When closed, the lid keeps the inner portion in place and thus adds to the strength of the container. In some embodiments of the invention, the ease of set up may be further improved by forming the lid from a continuous sheet of material, so that the lid may be closed in one motion, rather than the sequence of steps required with other lids. The lid may be composed of multiple layers connected by folds which act as springs, thus providing a springed, cushioned barrier to protect the contents of the container. In some embodiments of the invention, the lid may utilize flaps which add to the strength of the container. Furthermore, in some embodiments of the invention, no portion of the lid enters the cubic volume of the container, which would reduce the storage space available.

The container may be manufactured with a double glued seam by having opposing edges sealed to one another with two tabs, each sealed to an edge. This provides the container with greater strength, in addition to that provided by the double walled construction and lid. In some embodiments two such tabs are provided but only one is glued.

The container is intended to be cut from stock material and glued at a manufacturer's facility and shipped flat to the user, who erects the container.

BRIEF DESCRIPTION OF THE DRAWINGS

Embodiments of the invention are illustrated by way of example in the accompanying drawings.

DETAILED DESCRIPTION

I. Manufacture of the Container

Figure 1:
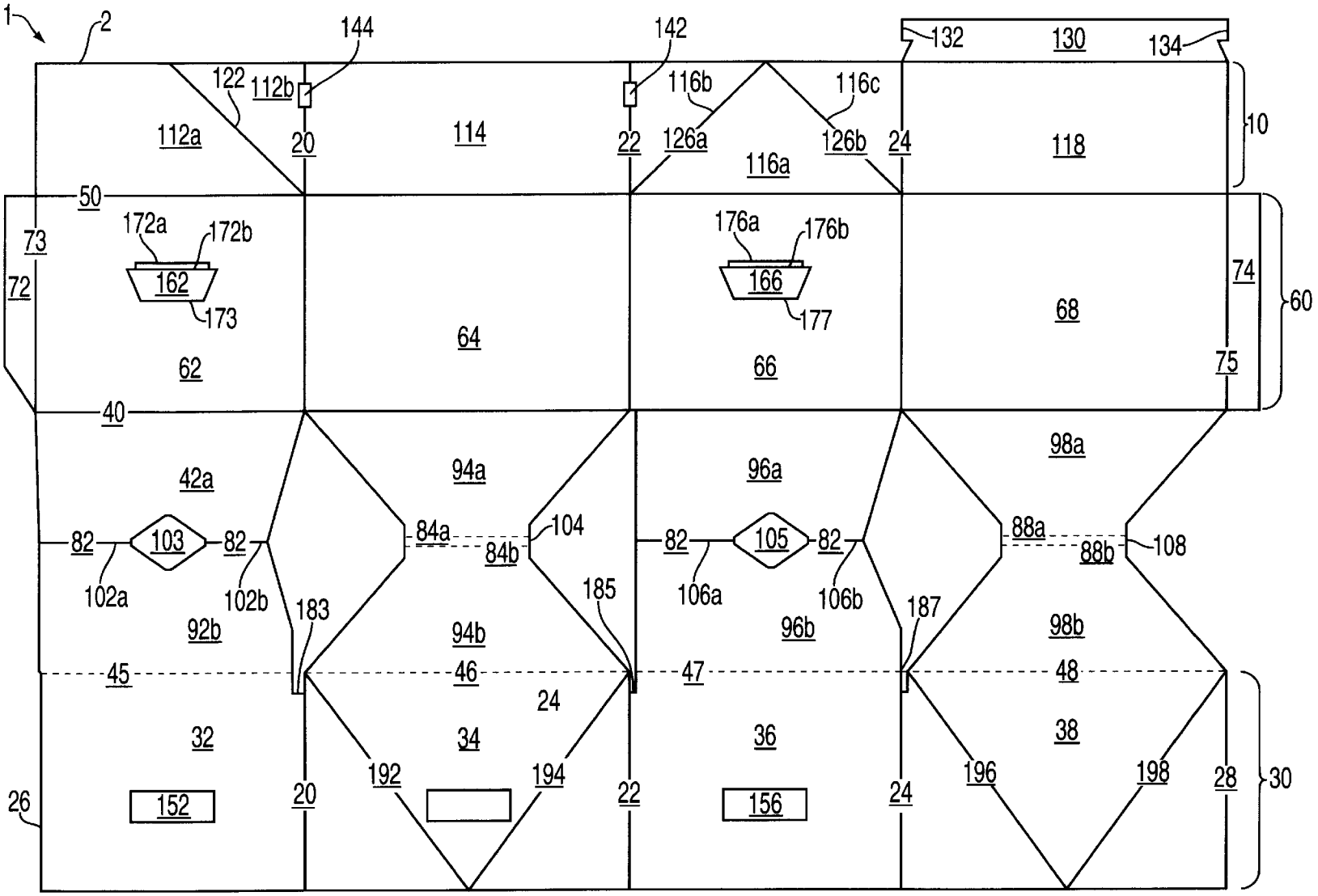
FIG. 1 shows an embodiment of a sheet of material used to form a container according to the present invention, after the sheet of material has been cut from stock material, but before the cut material is folded and glued and ready for shipping.
Figure 2:
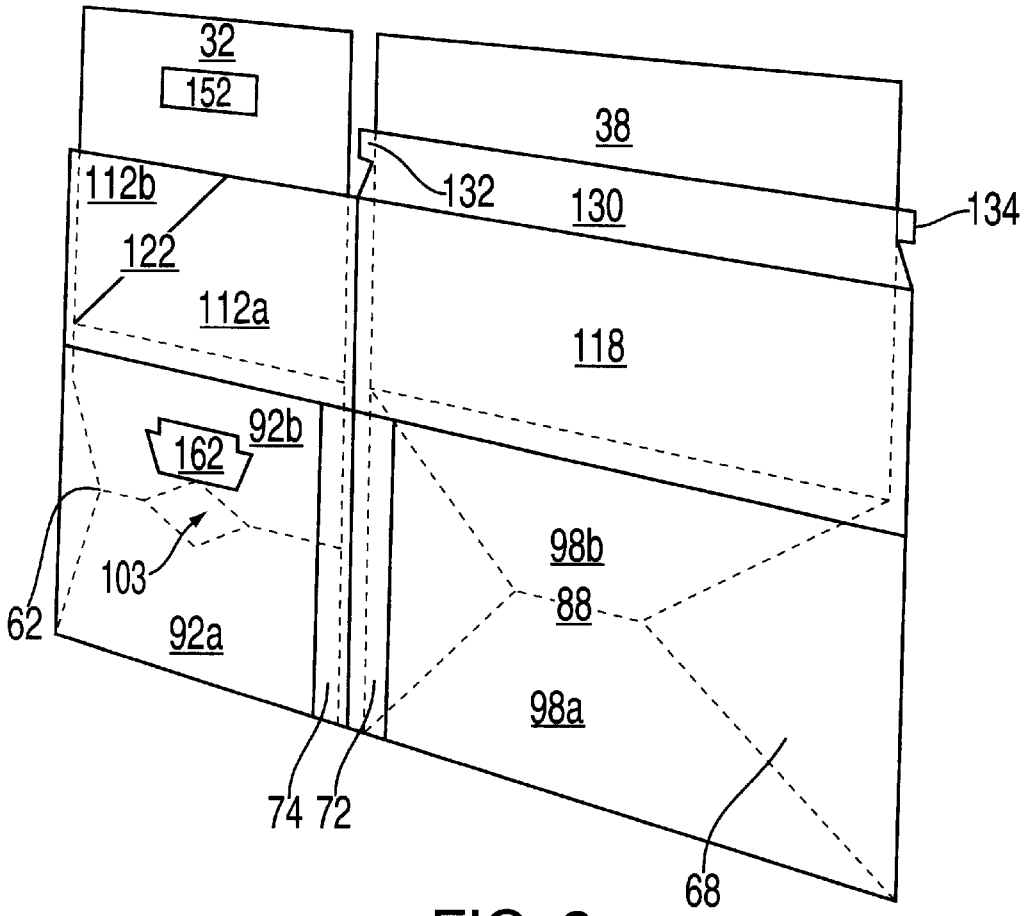
FIG. 2 shows a container formed from the sheet of FIG. 1, after the container has been fully manufactured, folded flat, and ready for shipment to the user.

Referring to FIG. 1, an embodiment of the present invention is described. A container according to an embodiment of the invention is formed from an integral sheet of material 1, preferably corrugated cardboard or chipboard. The material is cut using known methods to form cut sheet 2. To form the manufactured but not fully assembled container (as shown in FIG. 2), sheet 2 is folded along score line 40, then further folded along score lines 20 and 24. Edges 26 and 28 are coupled by fastening tab 72 to the portion of side panel 68 near edge 28 and fastening tab 74 to the portion of side panel 62 near edge 26. In an exemplary embodiment, edges 26 and 28 do not touch, but are hingedly coupled by tabs 72 and 74; in another embodiment edges 26 and 28 touch. In still another embodiment of the present invention tab 74 is glued but tab 72 is not glued. In another embodiment of the present invention edges 26 and 28 may be coupled by one rather than two tabs. Tabs 72 and 74 are fastened to panels 68 and 62 by glue. However, this fastening can also be achieved by, for example, tape, heat or mechanical fasteners such as staples. By fastening two tabs to opposing side panels the container is given greater strength.

The fully manufactured but not fully set up container according to this embodiment is shown in FIG. 2. The container as shown in FIG. 2 is able to be both shipped to the user and stored in a flat form. The user may then set up the container, and also may knock down the container back to its flat form after its use.

II. Set Up of the Container

Figure 8:
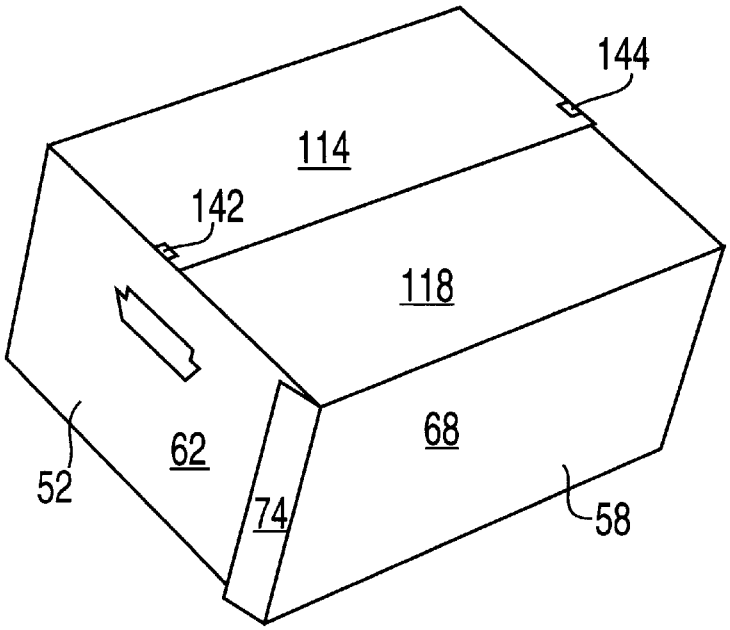
FIG. 8 shows the container of FIG. 2 fully assembled, with the lid closed.
Figure 3:
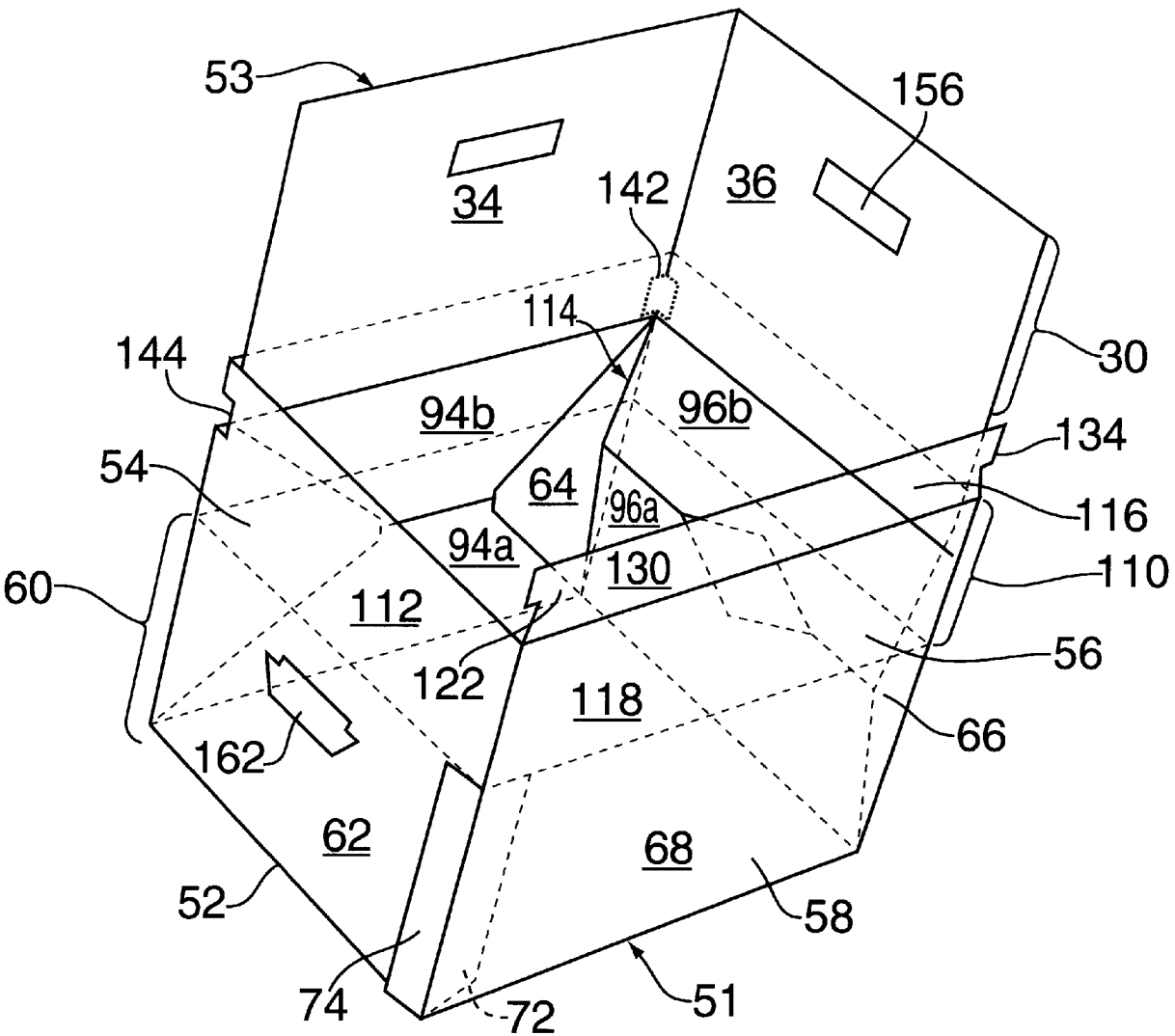
FIG. 3 shows a cutaway view of the container of FIG. 2 after the user has squared the box but before the box is telescoped to full set up.

Set up of a container from the collapsed flat condition as depicted in FIG. 2 into the fully erected container of FIG. 8 is depicted in FIGS. 3–7. The user will first expand the flat manufactured container of FIG. 2 into a rectangular parallelepiped box, pivoting sides 52, 54, 56 and 58 along score lines 73, 20, 22, 24 and 75, as shown by the cutaway view of the container in FIG. 3. With reference to FIG. 3, the box has four elongated rectangular sides 52, 54, 56 and 58, opposite panels having equal width, and with two open ends 51 and 53, the ends in this example being rectangular. Inner portion 30, comprised of panels 32, 34, 36 and 38, is ready to telescope into outer portion 60, comprised of panels 62, 64, 66 and 68. After inner portion 30 telescopes into the outer portion 60, panels 92*a*, 92*b*, 94*a*, 94*b*, 96*a*, 96*b*, 98*a* and 98*b* will join to form the bottom, and panels 112, 114, 116 and 118 will form lid 110.

Figures 4, 6:
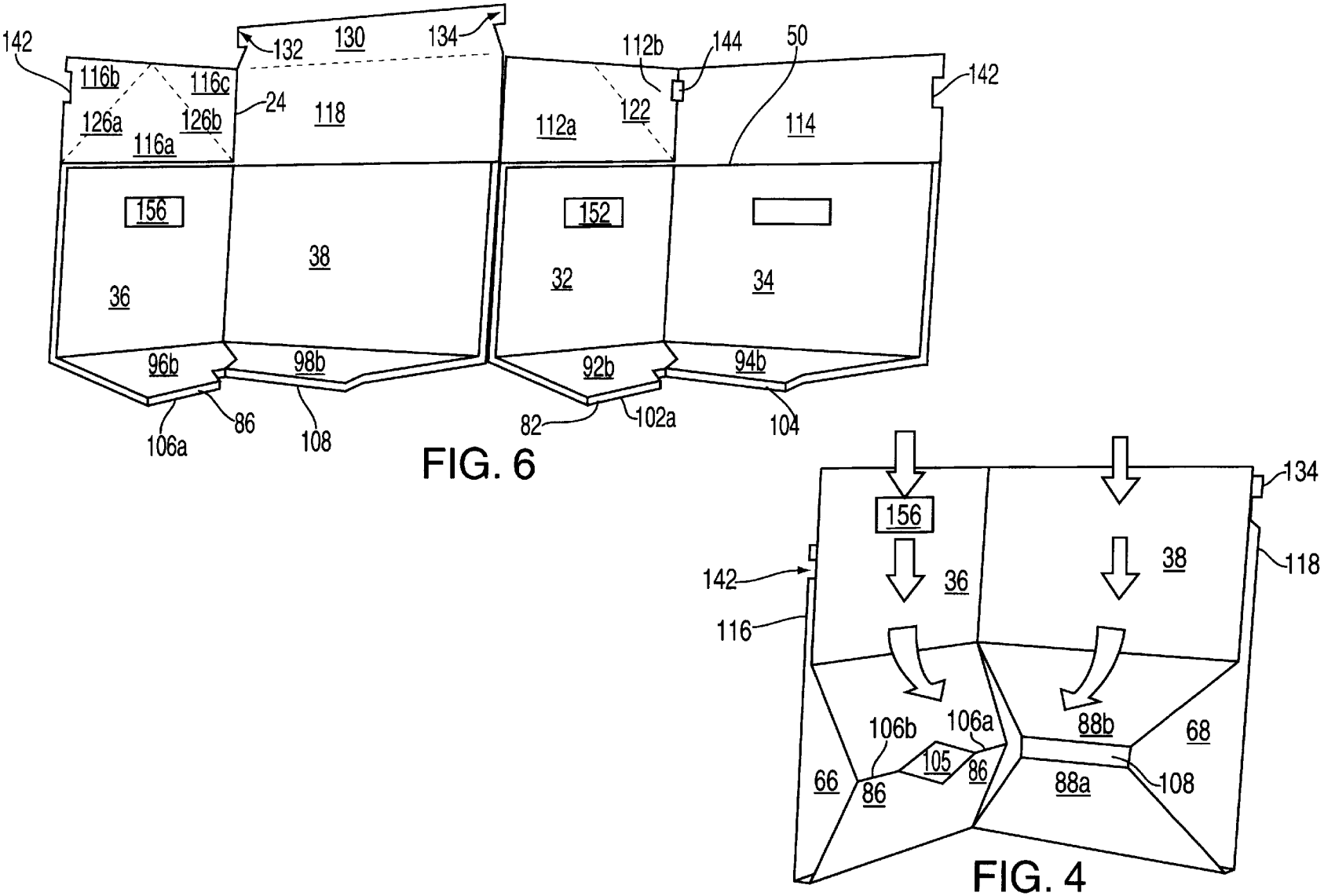
FIG. 4 shows a cutaway view of the container of FIG. 2 with the inner portion being telescoped into the outer portion.
FIG. 6 shows a cutaway view of the container of FIG. 2 after the inner portion has been telescoped into the outer portion, shown opened to reveal the configuration of the panels of the container.

As shown with respect to FIG. 4, the user further sets up the box by pressing down on inner portion 30, compressing bottom panels 92*a*, 92*b*, 94*a*, 94*b*, 96*a*, 96*b*, 98*a* and 98*b* and causing bottom panels 92*a*, 92*b*, 94*a*, 94*b*, 96*a*, 96*b*, 98*a* and 98*b* to fold along respective score lines 82, 84, 86 and 88, respective score lines 45–48 and score line 40. Gaps 183, 185 and 187 allow the lower portion of the inner portion 30 to compress to enter outer portion 60. Score lines 192, 194, 196 and 198, shown in FIG. 1, enable side panels 34 and 38 to compress slightly to allow inner portion 30 to enter outer portion 60. In addition, panel 32 has a slightly smaller width than panel 62, further enabling inner portion 30 to enter outer portion 60.

Prior art telescoping containers achieved a narrowing of the inner portion by creating the flat sheet used to form the container in an ellipsoid shape, with the section creating the outer portion having an outer edge of convex shape and the section creating the inner portion having an outer edge of concave shape. Such a container cannot lie flat when glued and cannot be glued by machine; the container of the present invention may have edges of straight, not curved, shape, and thus can be glued by machine and in addition lies flat after glueing.

As bottom panels 92*a*, 92*b*, 94*a*, 94*b*, 96*a*, 96*b*, 98*a* and 98*b* compress, edge 102*a* of bottom panel 92, formed as a result of the fold along score line 82, and edge 106*b* of bottom panel 96, formed as a result of the fold along score line 86, slide into the area between bottom panels 98*a* and 98*b*. In like manner, edges 102*b* and 106*a* slide into the area between bottom panels 94*a* and 94*b*. Also, as the bottom panels 92*a*, 92*b*, 94*a*, 94*b*, 96*a*, 96*b*, 98*a* and 98*b* fold, edges 104 and 108 are formed and meet in the region formed by cut-out areas 103 and 105.

Figure 5:
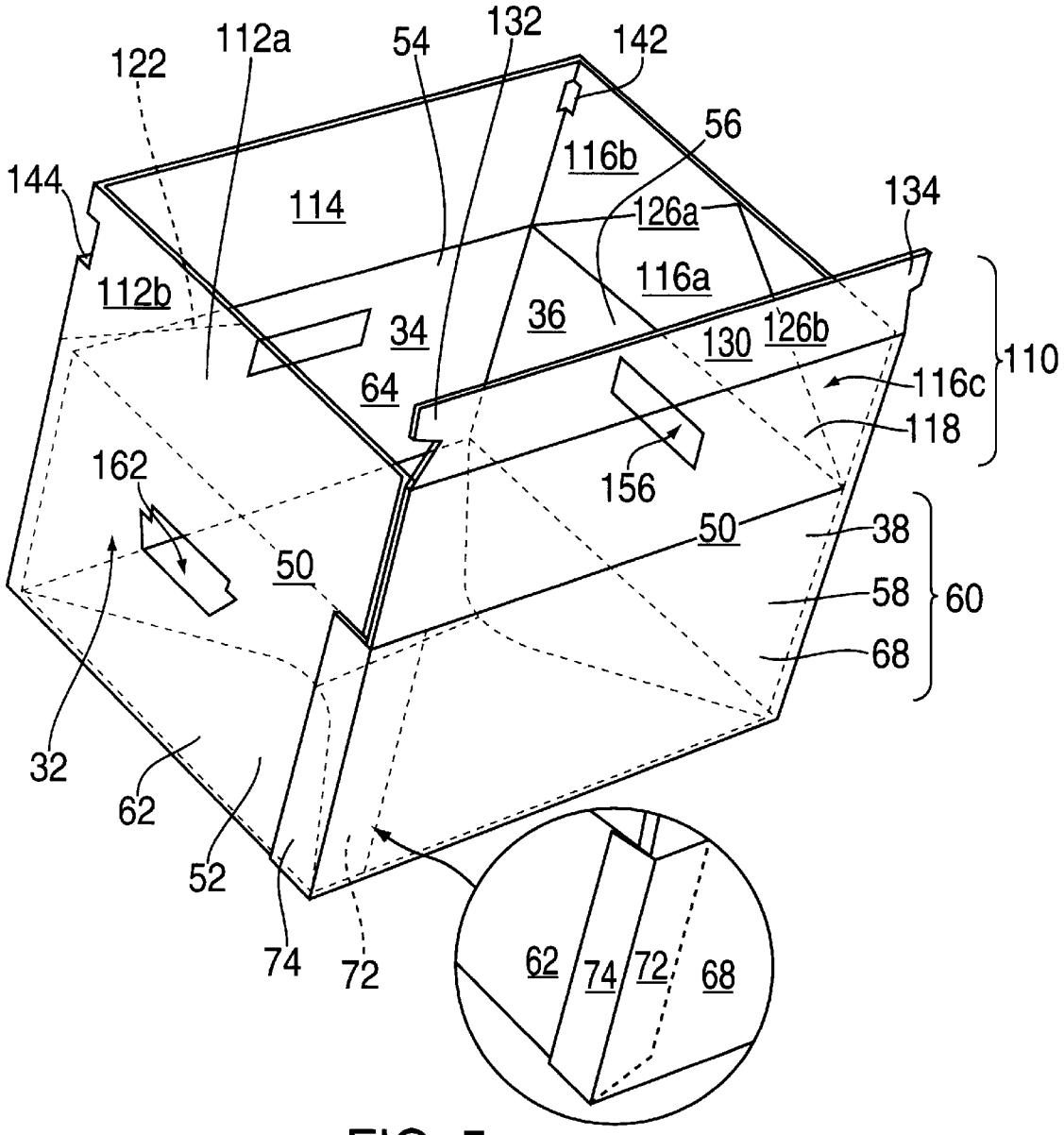
FIG. 5 shows the container of FIG. 2 after the inner portion has been telescoped into the outer portion.

After the above described set up by the user, the container is formed, as shown in FIG. 5, as a rectangular parallelepiped box with an open top. A first side 52 is formed from panels 32 and 62, a second side 54 is formed from panels 34 and 64, a third side 56 is formed from panels 36 and 66, a fourth side 58 is formed from panels 38 and 68, and the bottom is formed by panels 92*a*, 92*b*, 94*a*, 94*b*, 96*a*, 96*b*, 98*a* and 98*b*. FIG. 6 shows a cutaway view of the container at this stage, shown opened to reveal the configuration of the panels of the container.

Figure 7:
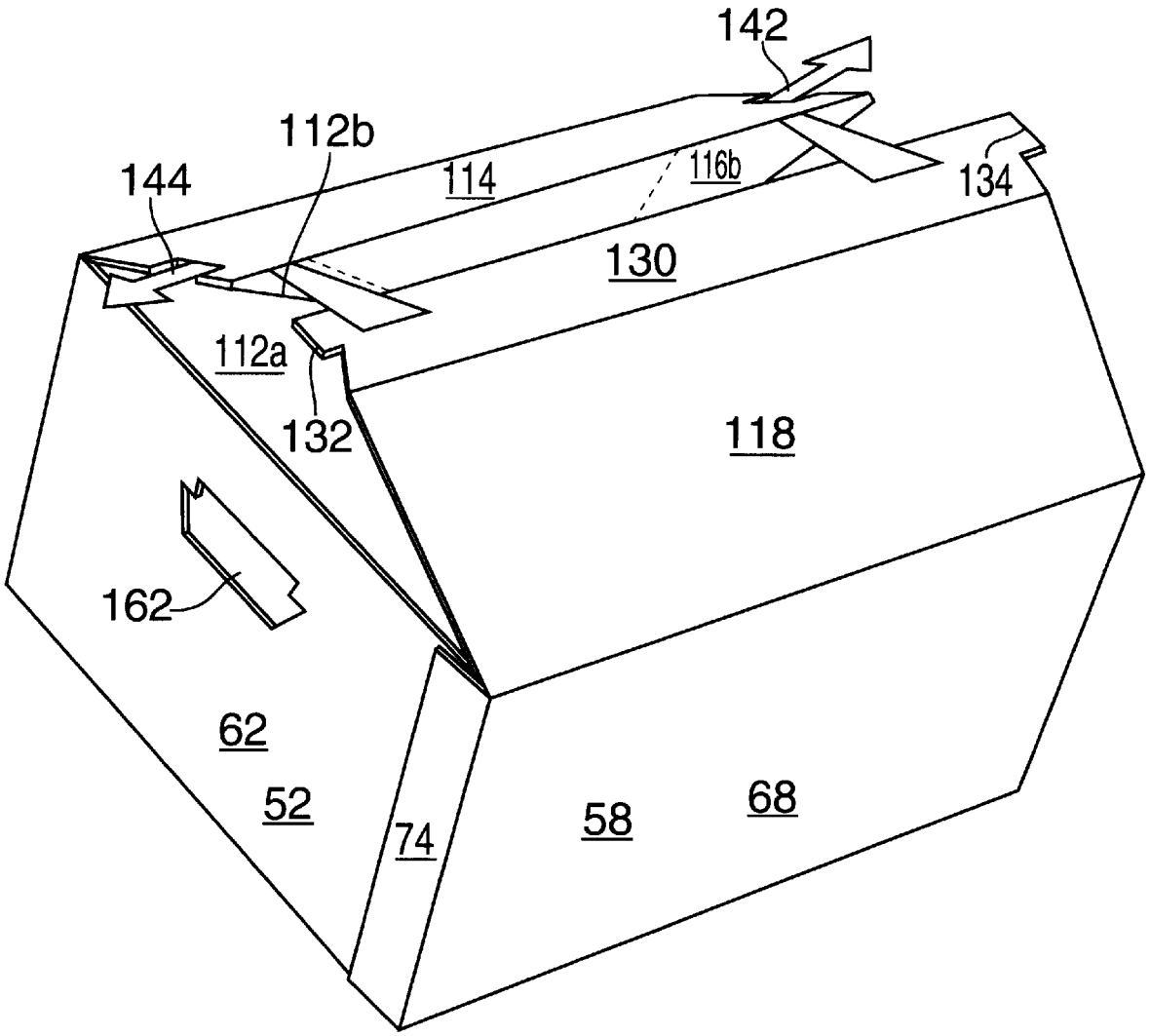
FIG. 7 shows the container of FIG. 2 fully set up, with the lid being drawn closed.

After creating the open topped container shown in FIG. 5 and typically after contents are placed in the box, the user closes lid 110, as shown in FIG. 7. In this embodiment, lid 110 is formed from panels 112, 114, 116 and 118, which comprise one continuous sheet of material extending from outer portion 60. The user folds panels 112–118 inward, panels 112 and 116 folding inward towards each other, and panels 114 and 118 folding inward towards each other. Score lines 126*a* and 126*b* allow panel section 116*a* to fold inward while panel sections 116*b* and 116*c* fold backwards to rest on top of panel section 116*a*. In like manner, score line 122 allows panel section 112*a* to fold inward while panel section 112*b* folds backwards to rest on top of panel section 112*a*. Flap 130 slides into the region created by panel section 112*b* folding back on panel section 112*a* and by panel section 116*b* folding back on panel section 116*a*. As shown in FIG. 7, to secure lid 110 in a closed position, tab 132 fits into notch 142 and tab 134 fits into notch 144.

Since in this embodiment lid 110 extends from outer portion 60, lid 110 acts to hold inner portion 30 in position and to strengthen the overall structure of the container. Lid 110 is easy to close as it is formed from a continuous sheet of material, so that the lid may be closed in one motion, rather than by the sequence of steps required with other lids. Since lid 110 is composed of three layers (e.g., portions 116*a*, 116*b*, and 114 form three layers), and because these layers are connected by folds at score lines 20, 22, 24, 122, 126*a*, and 126*b* which act as springs, lid 110 provides a springed, cushioned barrier to protect the contents of the container. Furthermore, flap 130 closes lid 110 without entering the cubic volume of the container and thus reducing the storage space available.

FIG. 8 shows the container of FIGS. 1–7 fully set up with the lid closed.

As shown with respect to FIGS. 1 and 5, tab 162 is formed from perforation 173, and folds inward along score lines 172*a* and 172*b*, through hand hole 152 to connect panel 62 to panel 32 and to maintain the form of the container. In like manner tab 166 is formed from perforation 177, and folds inward along score lines 176*a* and 176*b*, through hand hole 156. Hand holes 152 and 156 allow the container to be easily carried by providing gripping areas.

In alternate embodiments lid 110 extends from inner portion 30 rather than outer portion 60, or from both inner portion 30 and outer portion 60. In further embodiments lid 110 may be comprised of multiple panels instead of one continuous sheet, or may be attached to only one or a subset of side panels 32, 34, 36, 38, 62, 64, 66 and 68. Lid 110 may be sealed by a structure similar to that of flap 130 and tabs 132 and 134 or by other means such as glueing or stapling. In addition, in another embodiment lid 110 may not completely seal the top end of the container.

Figure 9:
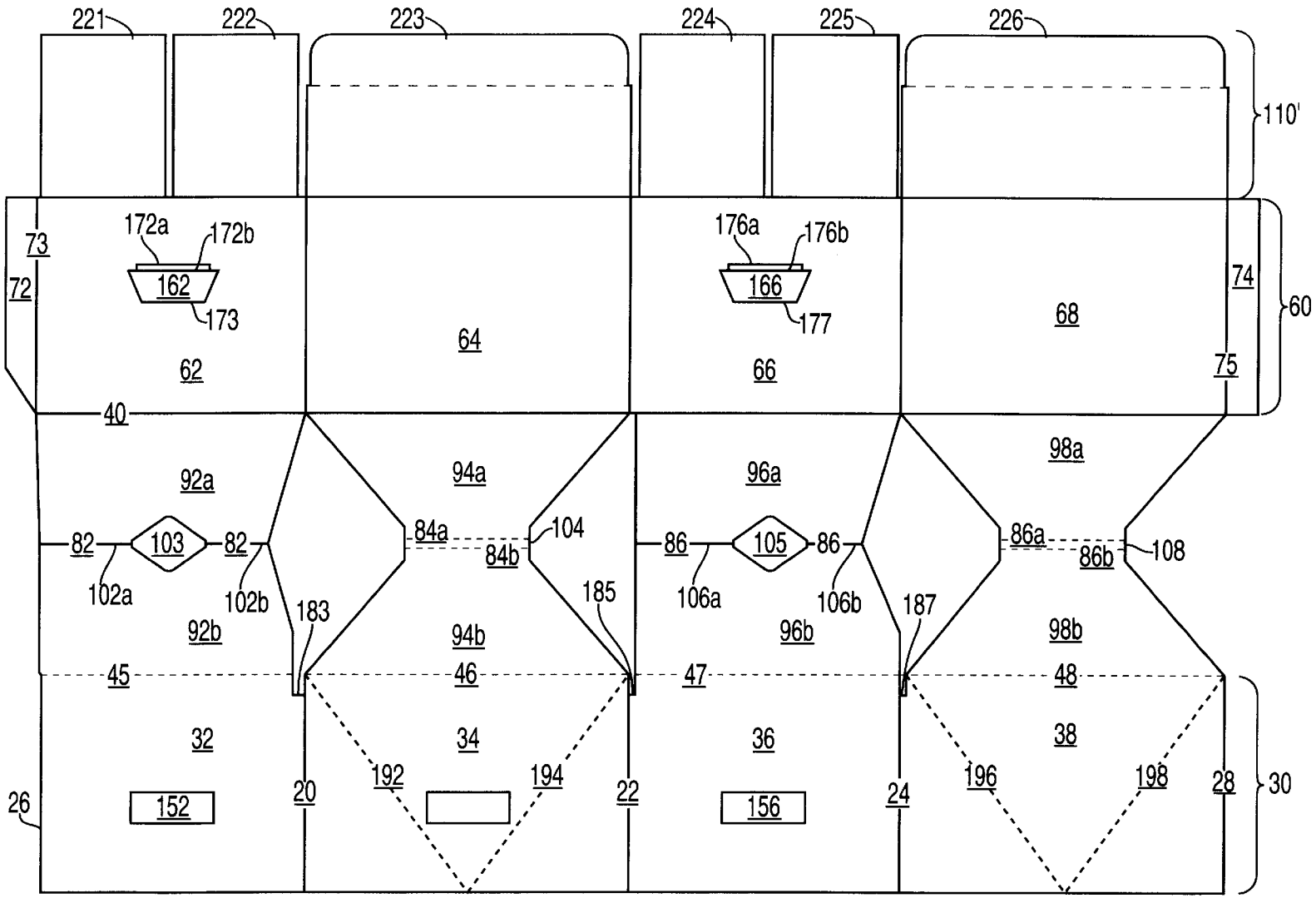
FIG. 9 shows an embodiment of a sheet of material used to from a container according to the present invention, where the lid is composed of multiple panels.
Figure 10:
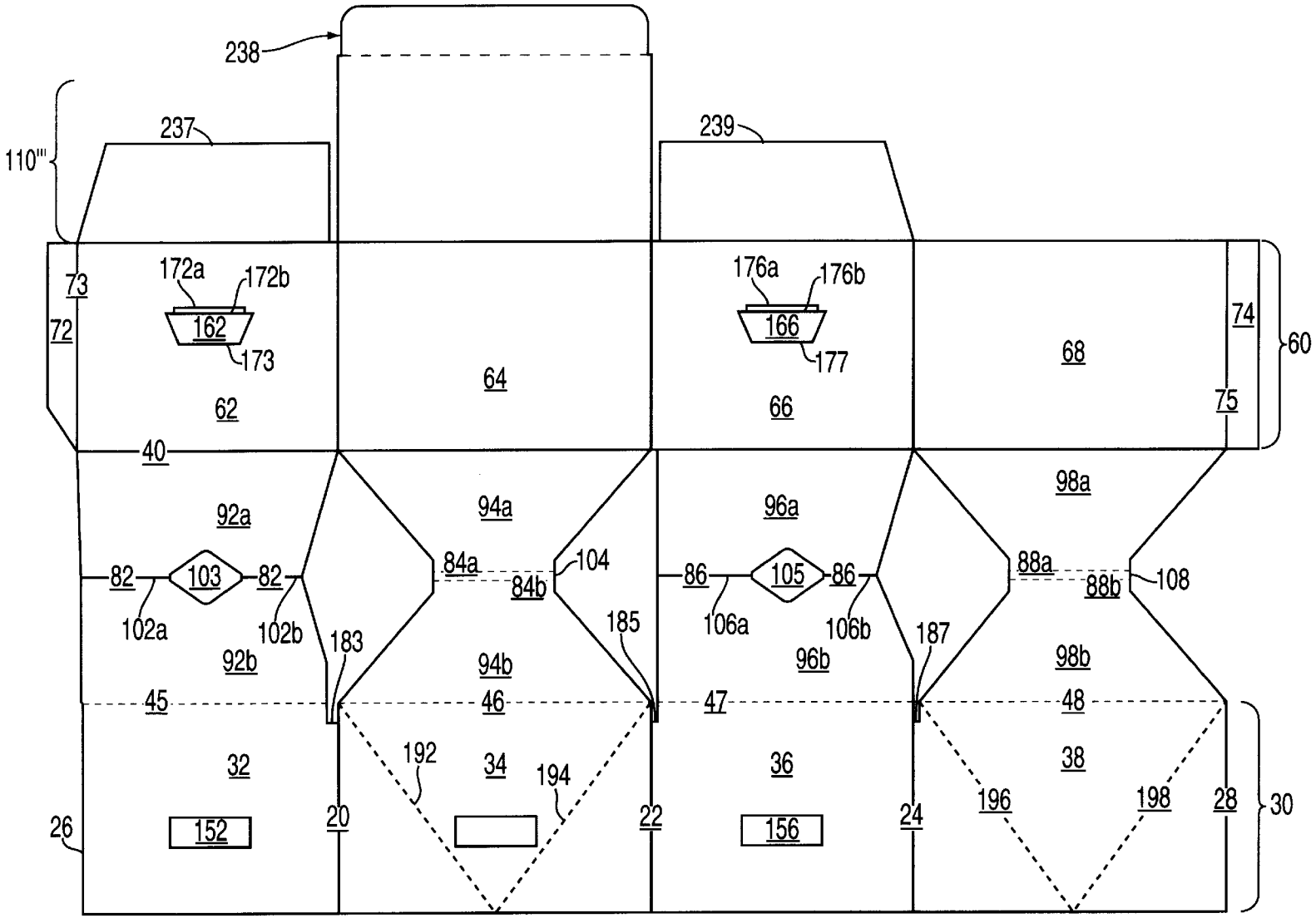
FIG. 10 shows an embodiment of a sheet of material used to form a container according to the present invention, where the lid is composed of multiple panels and is not attached to all the panels of the outer sleeve.
Figure 11:
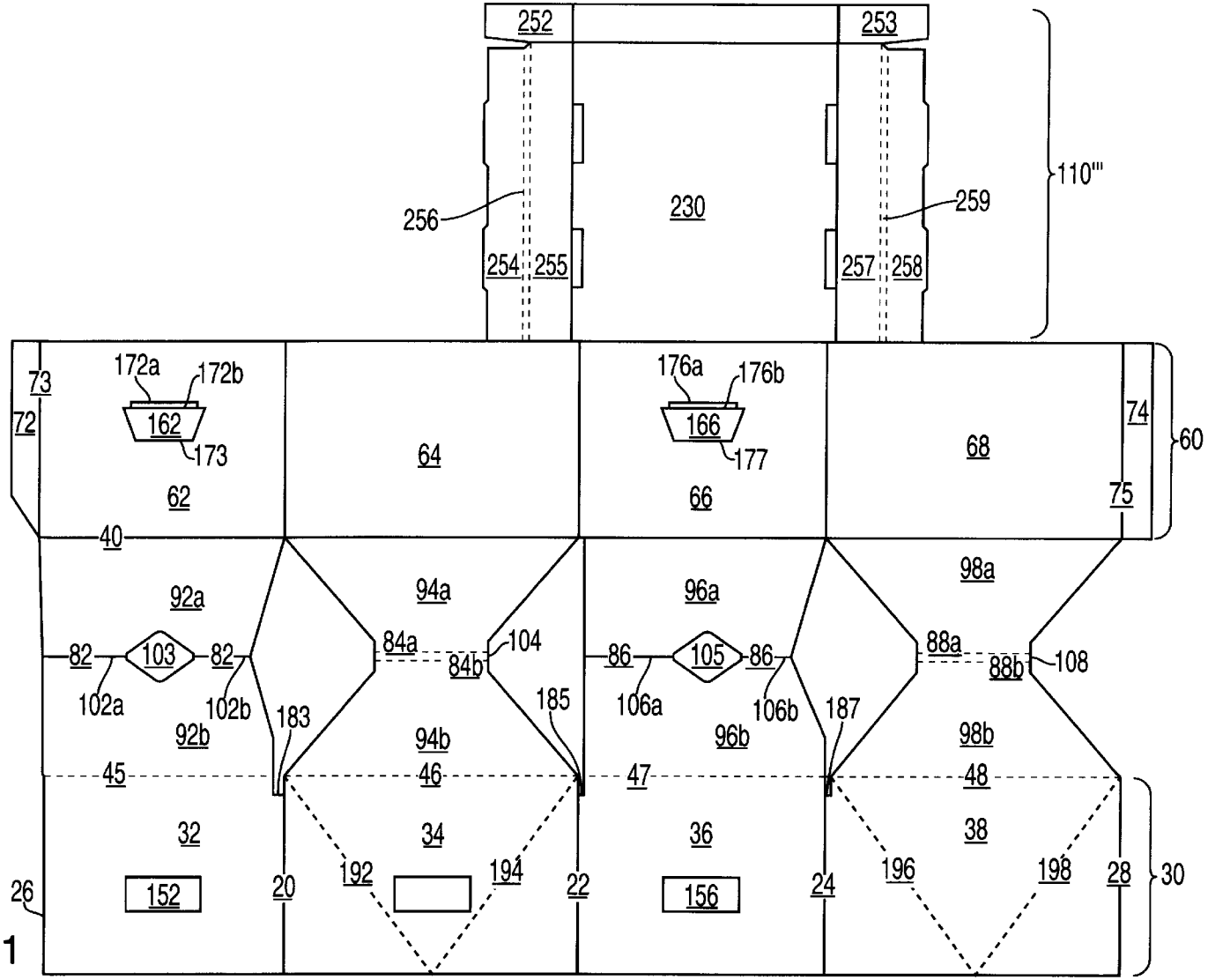
FIG. 11 shows an embodiment of a sheet of material used to form a container according to the present invention, where the lid is not attached to all the panels of the outer sleeve.
Figure 12:
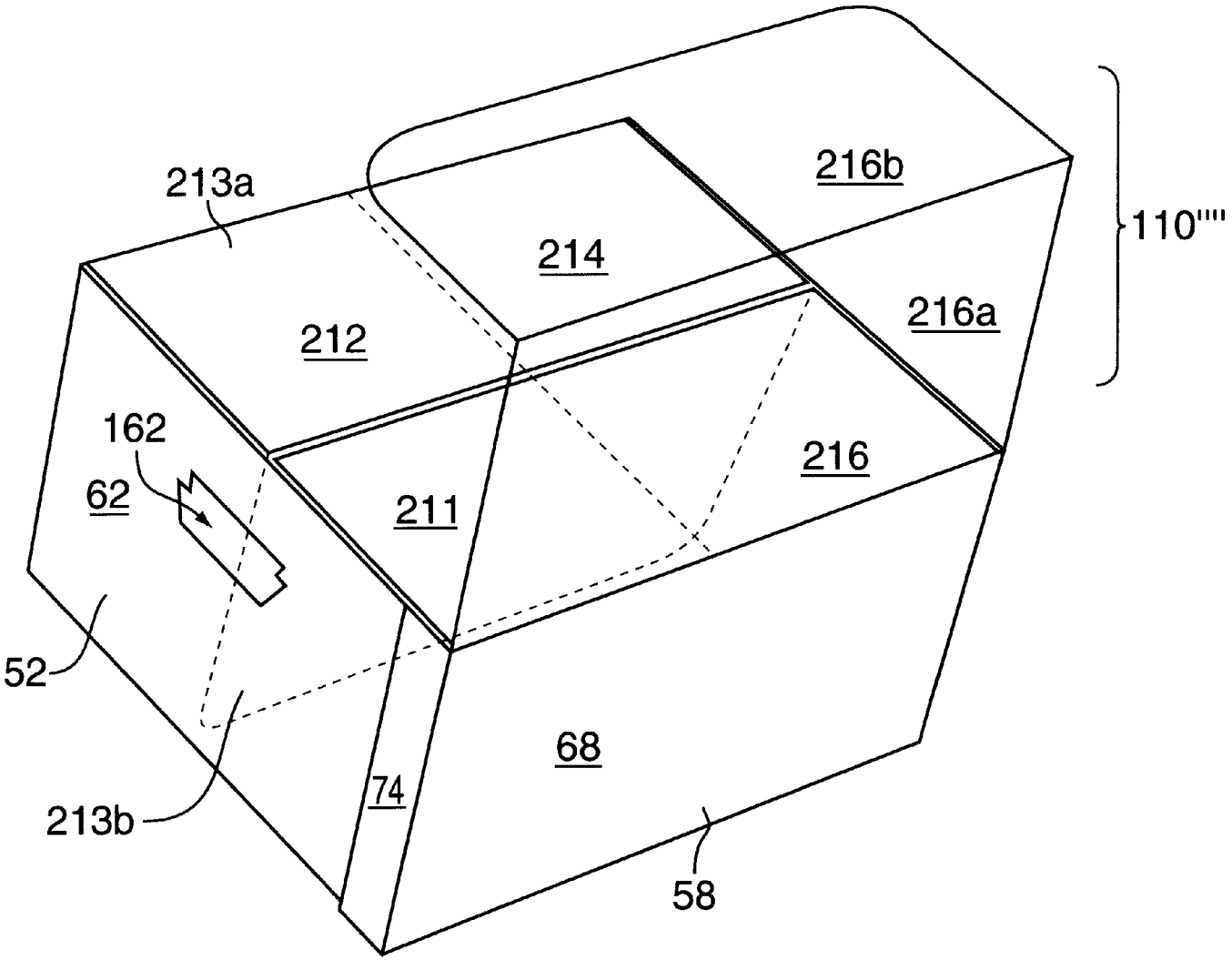
FIG. 12 shows an embodiment of the present invention where the lid is formed from multiple panels which provide a barrier to separate the contents of the container.
Figure 13:
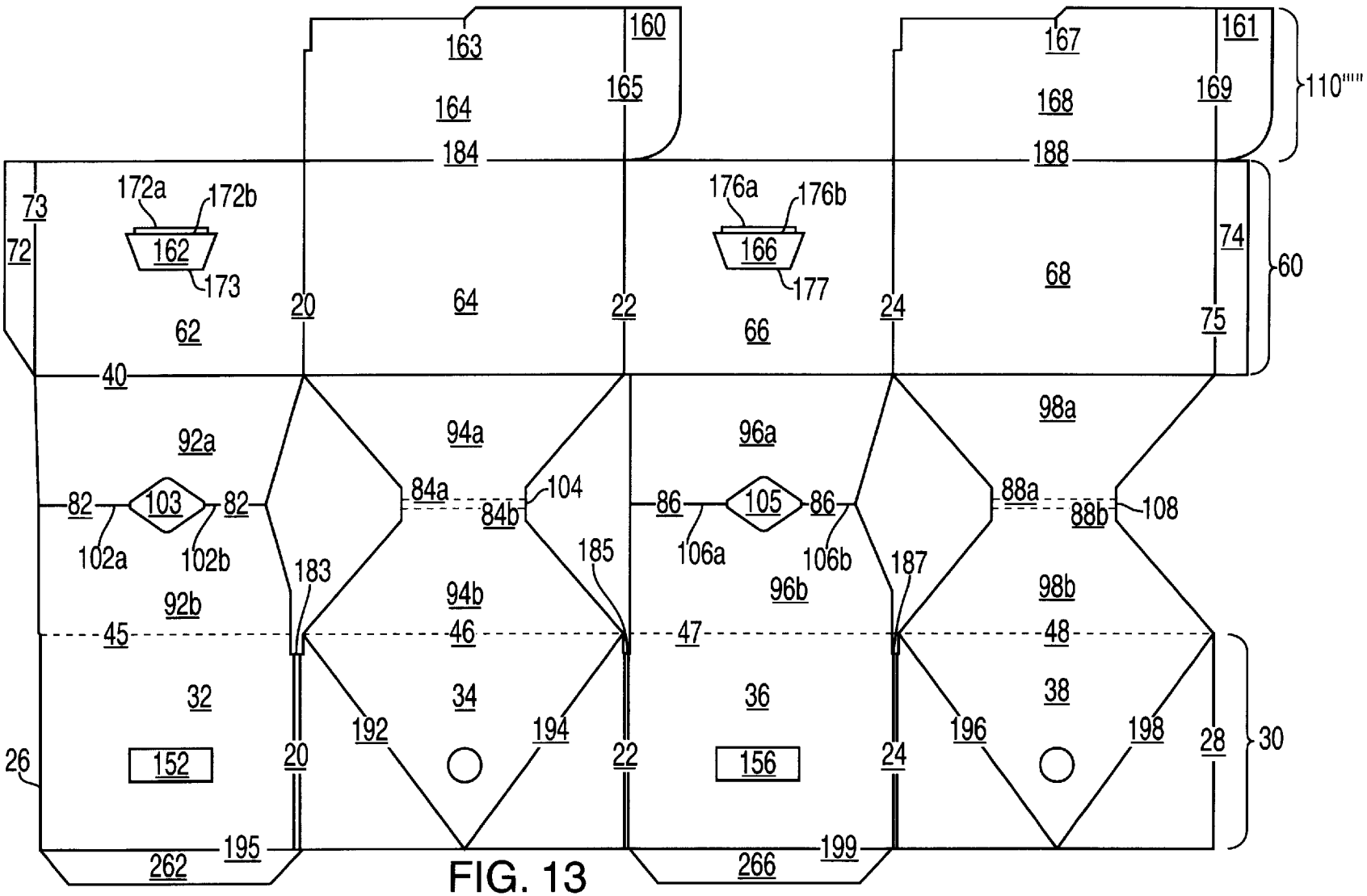
FIG. 13 shows an embodiment of a sheet of material used to from a container according to the present invention, after the sheet of material has been cut from stock material, but before the cut material is folded and glued and ready for shipping.

FIG. 9, for example, illustrates an embodiment of the present invention where lid 110' is formed from multiple panels 221–226, attached to outer portion 60. FIG. 10 depicts an embodiment of the present invention where lid 110" is formed from three panels 237–239, attached to outer portion 60. FIG. 11 depicts an embodiment of the present invention where lid 110'" is comprised of panels 250–259 which fold to form one piece which is attached to only one panel 66 of outer portion 60. FIG. 12 illustrates an embodiment of the present invention where lid 110"" is formed from multiple panels 211–216, attached to outer portion 60, and where panels 213*b* and 216*b* extend to the interior of the container and provide a barrier to separate the contents of the container.

Figure 14:
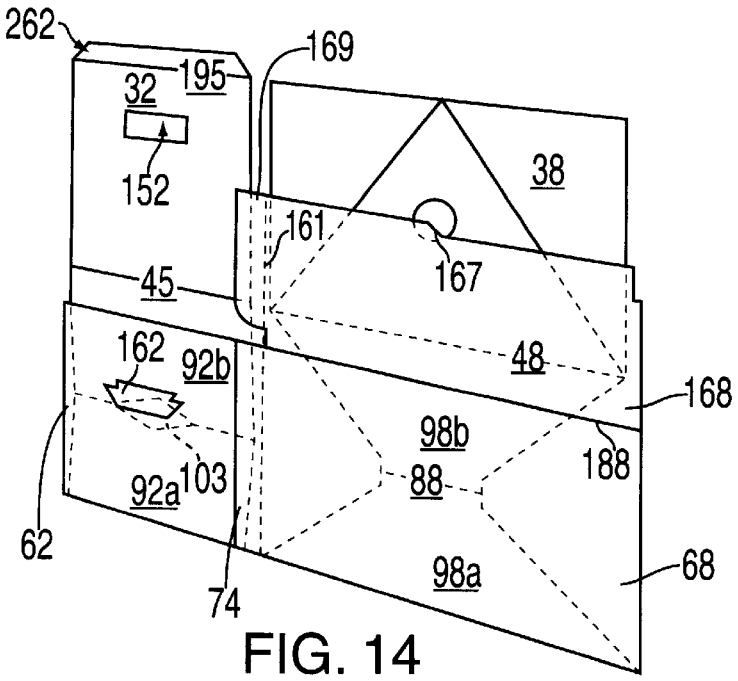
FIG. 14 shows a container formed from the sheet of FIG. 13, after the container has been fully manufactured, folded flat, and ready for shipment to the user.
Figure 15:
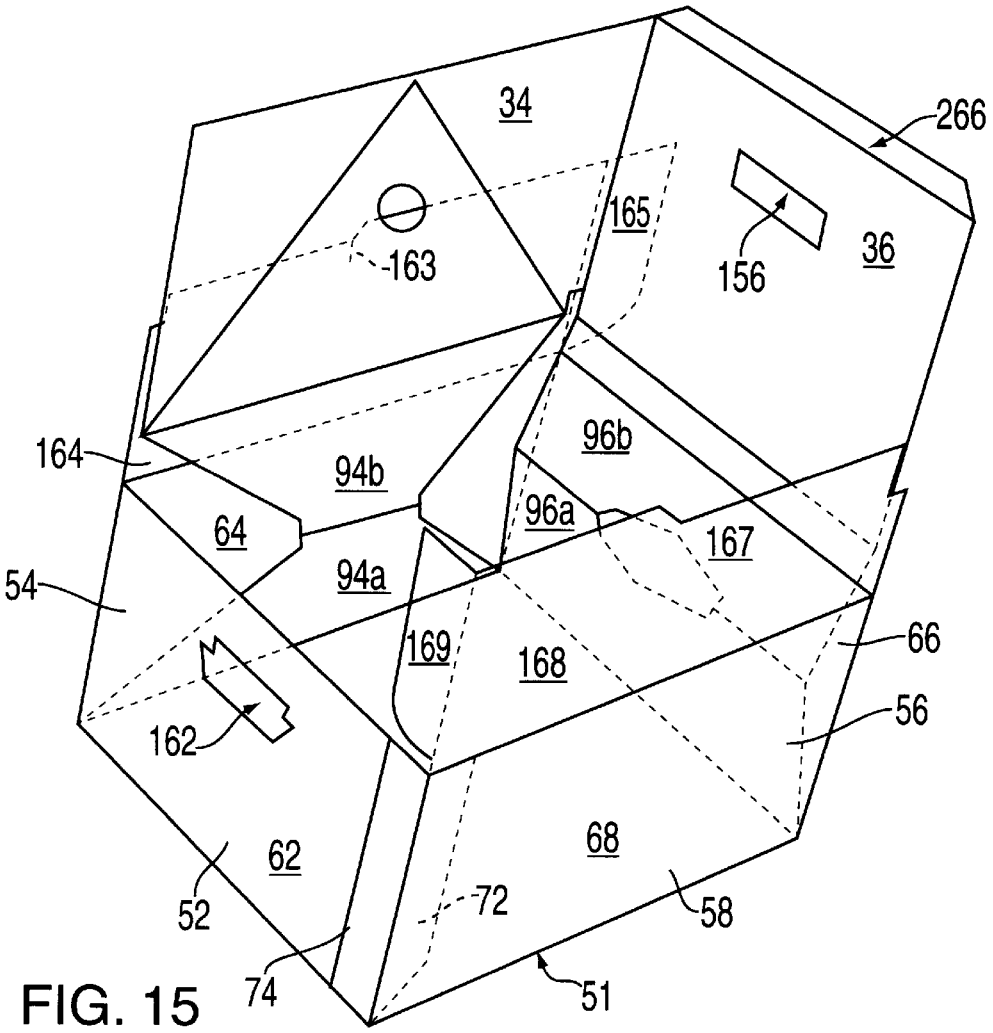
FIG. 15 shows a cutaway view of the container of FIG. 14 after the user has squared the container but before the container is telescoped to full set up.
Figure 16:
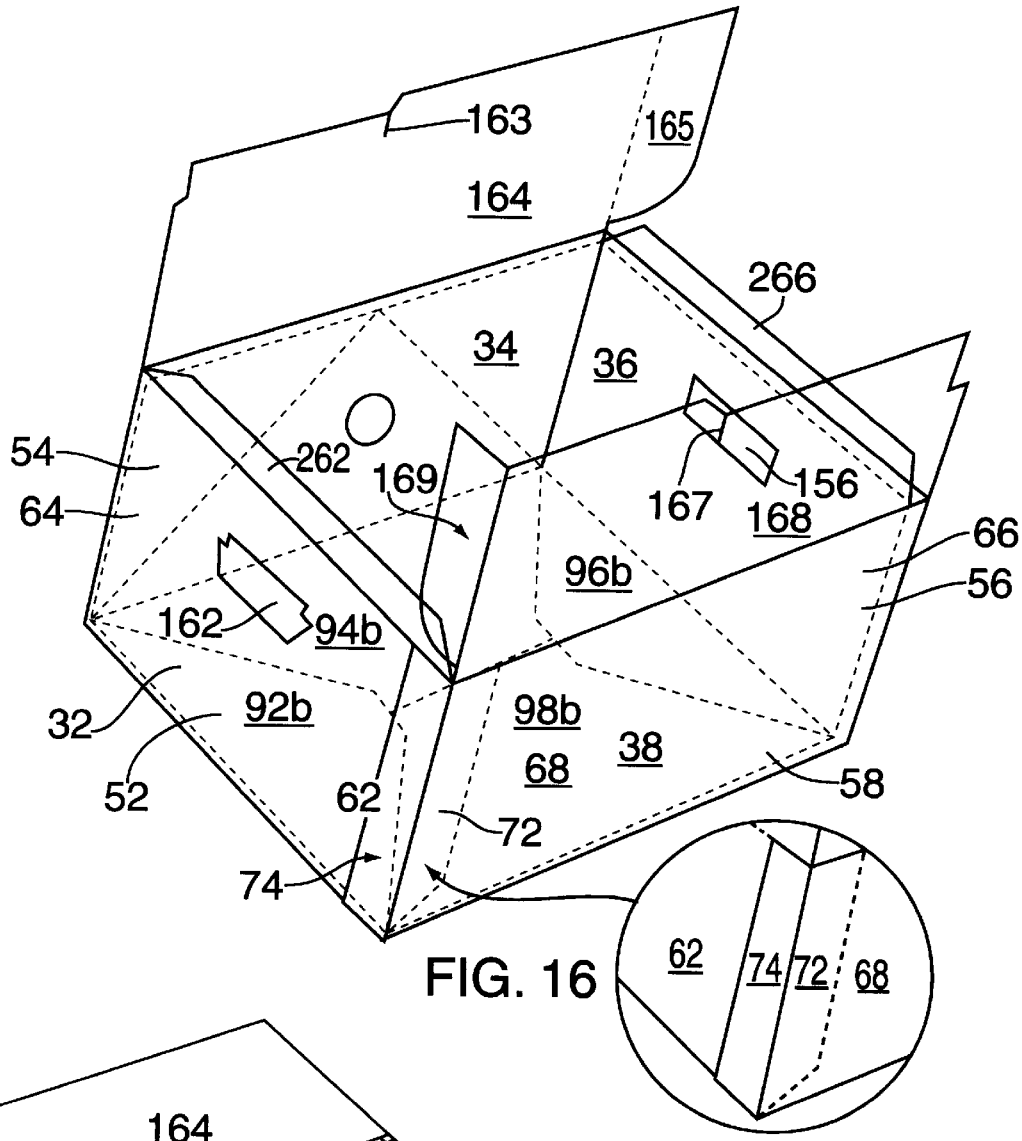
FIG. 16 shows the container of FIG. 14 after the inner portion is telescoped into the outer portion but before the lid is closed.
Figure 18:
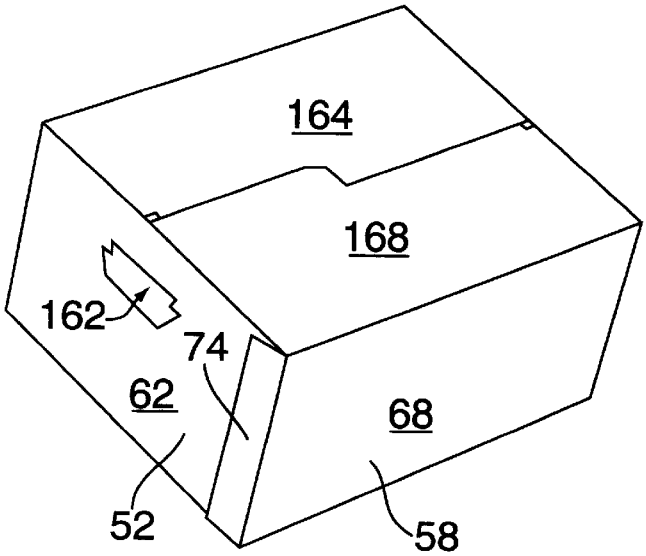
FIG. 18 shows the container of FIG. 14 with the lid closed.
Figure 17:
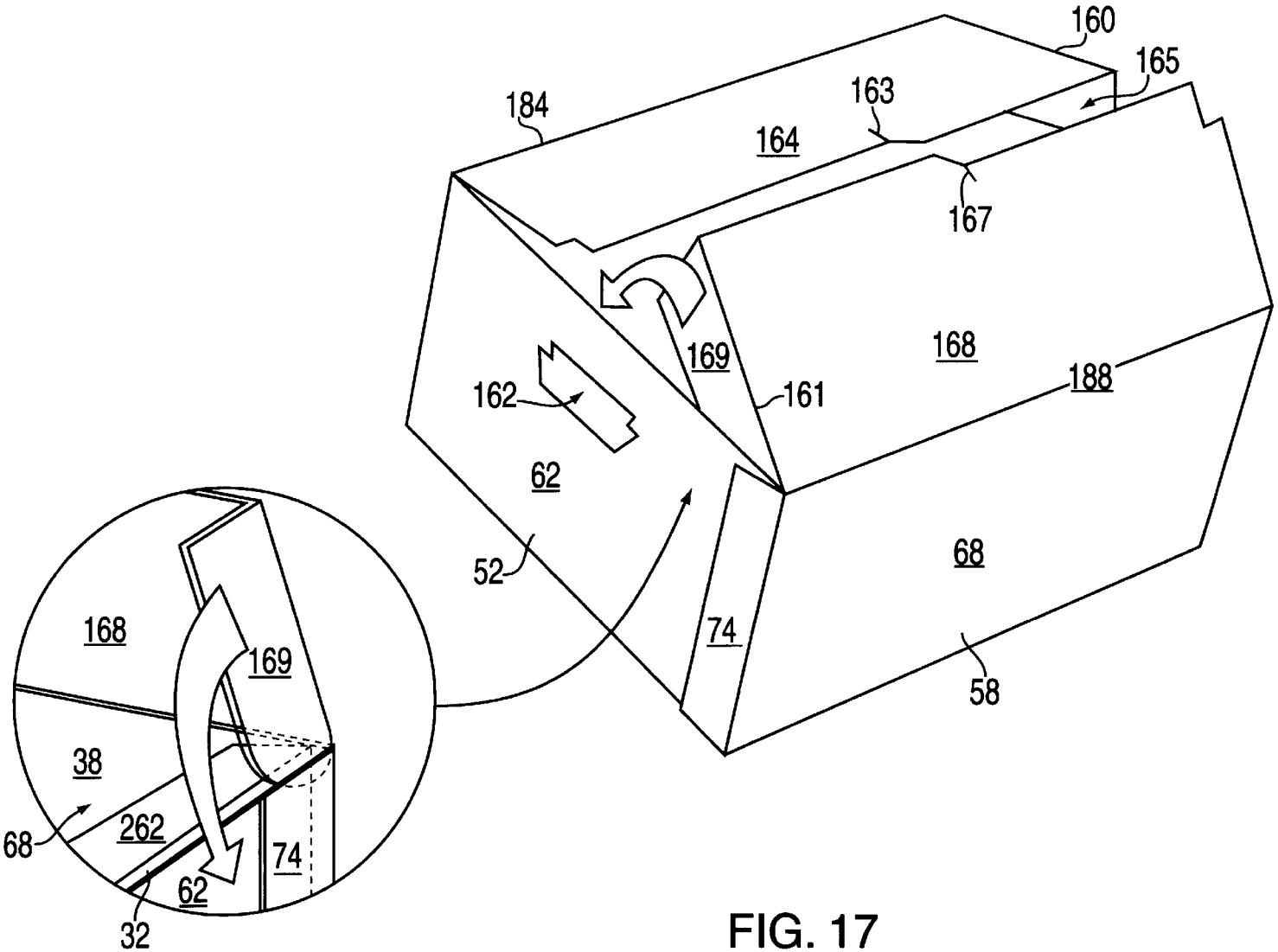
FIG. 17 shows the container of FIG. 14 as the lid is being closed.

FIGS. 13–18 depict an embodiment of a sheet of material used to form a container according to the present invention where lid 110""' is formed from two main interlocking flaps 164 and 168 and two smaller side flaps 262 and 266. FIG. 14 shows the container formed from the sheet of FIG. 13 after the container is fully manufactured, folded flat, and ready for shipment to the user. FIG. 15 shows a cutaway view of the container of FIG. 14 after the user has squared the container but before the container is telescoped to full set up. FIG. 16 shows the container of FIG. 14 after inner portion 30 is telescoped into outer portion 60 but before lid 11"" is closed. FIG. 17 shows lid 110"" of the container of FIG. 14 being closed. FIG. 18 shows the container of FIG. 14 with lid 110"" closed.

The operation of the container of the embodiment depicted in FIGS. 13–18 is substantially similar to that of the embodiment depicted in FIGS. 1–8, but for the structure and operation of lid 110"". Lid 110"" of the embodiment of FIGS. 13–18 is comprised of two main interlocking flaps 164 and 168 attached to panels 64 and 68, respectively, of outer portion 60 and two side flaps 262 and 266 attached to panels 32 and 36, respectively, of inner portion 30. The closure of lid 110"" of the embodiment of FIGS. 13–18 is described with respect to FIGS. 13 and 17. Interlocking flaps 164 and 168 fold inward towards each other along score lines 184 and 188, respectively. Flap 165, connected to flap 164 at score line 160, is folded to be coplanar with side 56. As flap 164 folds inward flap 165 slides into the space created between panels 36 and 66. Similarly, flap 169, connected to flap 168 at score line 161, is folded to be coplanar with side 52. As flap 168 folds inward flap 169 slides into the space created between panels 32 and 62. Flaps 165 and 169 increase the rigidity of the container and hold flaps 164 and 168 in position. Flap 262, connected to panel 32, folds inward at score line 195 to lie underneath flaps 164 and 168. Similarly, flap 266, connected to panel 36, folds inward at score line 199. Flaps 262 and 266 provide non-abrasive surfaces for the user to press down on while telescoping inner portion 30 into outer portion 60, provide hand holds for the user to grip while collapsing container 1, provide structural stability by keeping sides 54 and 58 at right angles to sides 52 and 56 and by providing support for panels 164 and 168, and provide a guide for flaps 165 and 169 when entering into the spaces between the panels of sides 52 and 56. Prior art containers without the non-abrasive surfaces of flaps 262 and 266 required users to press down on a sharp, abrasive surface to assemble the container. As flaps 164 and 168 join, slits 163 and 167 allow flaps 164 and 168 to interlock and thus keep lid 110"" closed.

In the embodiment of FIGS. 13–18 lid 110"" extends from outer portion 60 and thus acts to hold inner portion 30 in position and to strengthen the overall structure of the container. In this embodiment lid 110"" further strengthens the container as flaps 165, 169, 262 and 266 help maintain the rigidity of the container. Furthermore, in this embodiment lid 110"" closes without entering the cubic volume of the container and thus reducing the storage space available.

III. Summary

While the invention has been described in connection with illustrated embodiments, it is not intended to limit the invention to the particular forms set forth above, but, on the contrary, is intended to cover such alternatives, modifications, and equivalents as may be included within the spirit and scope of the invention as defined by the appended claims.

For example, the materials used to construct the container are not limited to corrugated cardboard or chipboard, but may be any foldable material. The container may be constructed out of one integral piece of material, or may be fabricated from multiple components glued or otherwise attached to act as one piece of material. It may be of a shape other than rectangular, and may have a number of sides other than four. The lid may extend from the inner portion rather than the outer portion, may be comprised of multiple panels, and may be sealed by means such as glueing or stapling. In another embodiment, the lid may not completely close the top end of the container. In yet another embodiment, flaps on the lid may extend to the interior of the container and provide a barrier to separate the contents.

What is claimed is:

1. A collapsible container comprised of:

an inner sleeve portion having a lower end and an upper end;

an outer sleeve portion having a lower end and an upper end, the inner sleeve portion being snugly nestable within the outer sleeve portion;

a plurality of foldable panels disposed at the respective lower end of each of the inner and outer sleeve portions, the plurality of foldable panels hingeably connecting the inner sleeve portion and the outer sleeve portion, the inner sleeve portion being axially telescopable into the outer sleeve portion to erect the container, and the plurality of foldable panels forming a bottom of the container when the inner sleeve portion is axially telescoped into the outer sleeve portion; and a lid structure foldably connected to the upper end of the outer sleeve portion, the lid structure being closable to form a lid after the inner sleeve portion is axially telescoped into the outer sleeve portion.

2. The container of claim 1 wherein the lid structure is comprised of a continuous sheet.

3. The container of claim 2 wherein the foldable panels lie in substantially the same plane after the inner sleeve portion is axially telescoped into the outer sleeve portion.

4. The container of claim 1 wherein the lid structure forms a lid comprising a plurality of layers.

5. The container of claim 1 wherein:

the outer sleeve portion comprises a plurality of side panels;

the lid structure comprises a set of lid panels; and each lid panel in the set of lid panels is foldably connected to a corresponding side panel of the plurality of side panels at the upper end of the corresponding side panel of the plurality of side panels.

6. The container of claim 5 wherein each lid panel of one pair of opposing lid panels in the set of lid panels is divided by at least one score line; each score line enabling the corresponding lid panel to form a portion of the lid.

7. The container of claim 1 wherein:

the container is manufactured from a single piece of contiguous material having a first edge, the first edge having a first edge tab foldably connected to the first edge, and a second edge, the second edge having a second edge tab foldably connected to the second edge;

wherein the first edge tab is joined to at least a portion of the second edge; and wherein the second edge tab is joined to at least a portion of the first edge.

8. The container of claim 1 wherein:

the container is manufactured from a single piece of contiguous material having a first edge, the first edge having a first edge tab foldably connected to the first edge, and a second edge, the second edge having a second edge tab foldably connected to the second edge;

wherein the first edge tab is joined to at least a portion of the second edge.

9. The container of claim 1 wherein:

the lid structure is comprised of a first flap and a second flap, the first flap opposing the second flap after the inner sleeve portion is axially telescoped into the outer sleeve portion, the first flap having a first slit, and the second flap entering the first slit when the lid structure closes.

10. The container of claim 9 wherein the second flap has a second slit, the first flap entering the second slit when the lid structure closes.

11. The container of claim 1 further comprising a plurality of flaps, the plurality of flaps connected to the upper end of the inner sleeve portion, the plurality of flaps entering the container and dividing the container into compartments.

12. The container of claim 1 further comprising a plurality of flaps, the plurality of flaps connected to the upper end of the inner sleeve portion, the plurality of flaps providing a grip to enable a user to telescope the inner portion into the outer portion.

13. A collapsible container comprised of:

an inner sleeve portion having a lower end and an upper end;

an outer sleeve portion having a lower end and an upper end, the inner sleeve portion being snugly nestable within the outer sleeve portion;

a plurality of foldable panels disposed at the respective lower end of each of the inner and outer sleeve portions, the plurality of foldable panels hingeably connecting the inner sleeve portion and the outer sleeve portion, the inner sleeve portion being axially telescopable into the outer sleeve portion to erect the container, and the plurality of foldable panels forming a bottom of the container when the inner sleeve portion is axially telescoped into the outer sleeve portion; and a lid structure; wherein the inner sleeve portion, outer sleeve portion, and lid structure are all formed from a single sheet of material.

14. The container of claim 13 wherein the lid structure is comprised of a continuous sheet.

15. The container of claim 14 wherein the foldable panels lie in substantially the same plane after the inner sleeve portion is axially telescoped into the outer sleeve portion.

16. The container of claim 13 wherein the lid structure forms a lid comprising a plurality of layers.

17. The container of claim 13 wherein:

the inner sleeve portion and the outer sleeve portion each comprise a plurality of side panels;

the lid structure comprises a set of lid panels; and each lid panel in the set of lid panels is foldably connected to a corresponding side panel of the plurality of side panels at the upper end of the corresponding side panel of the plurality of side panels.

18. The container of claim 17 wherein each lid panel of one pair of opposing lid panels in the set of lid panels is divided by at least one score line; each score line enabling the corresponding lid panel to form a portion of the lid.

19. The container of claim 13 wherein:

the container is manufactured from a single piece of contiguous material having a first edge, the first edge having a first edge tab foldably connected to the first edge, and a second edge, the second edge having a second edge tab foldably connected to the second edge;

wherein the first edge tab is joined to at least a portion of the second edge; and wherein the second edge tab is joined to at least a portion of the first edge.

20. The container of claim 13 wherein:

the container is manufactured from a single piece of contiguous material having a first edge, the first edge having a first edge tab foldably connected to the first edge, and a second edge, the second edge having a second edge tab foldably connected to the second edge;

wherein the first edge tab is joined to at least a portion of the second edge.

21. A collapsible container comprised of:

an inner sleeve portion having a lower end and an upper end;

an outer sleeve portion having a lower end and an upper end, the inner sleeve portion being snugly nestable within the outer sleeve portion;

a plurality of foldable panels disposed at the respective lower end of each of the inner and outer sleeve portions, the plurality of foldable panels hingeably connecting the inner sleeve portion and the outer sleeve portion, the inner sleeve portion being axially telescopable into the outer sleeve portion to erect the container, and the plurality of foldable panels forming a bottom of the container when the inner sleeve portion is axially telescoped into the outer sleeve portion; and a lid structure comprised of a first flap, a second flap, a third flap and a fourth flap, the first and second flaps foldably connected to the upper end of the outer sleeve portion, the third and fourth flaps foldably connected to the upper end of the inner sleeve portion, the lid structure being able to form a lid after the inner sleeve portion is axially telescoped into the outer sleeve portion, the first flap opposing the second flap after the inner sleeve portion is axially telescoped into the outer sleeve portion, the first flap having a first slit, and the second flap entering the first slit when the lid structure closes.

22. The container of claim 21 wherein the second flap has a second slit, the first flap entering the second slit when the lid structure closes.

23. The container of claim 21 wherein the first flap and the second flap enter the container and divide the container into compartments.

24. The container of claim 21 wherein the third flap and the fourth flap provide grips to enable a user to telescope the inner portion into the outer portion.

* * * * *